US007802704B2

(12) United States Patent
Hatch et al.

(10) Patent No.: US 7,802,704 B2
(45) Date of Patent: Sep. 28, 2010

(54) GASOLINE CAN

(76) Inventors: David A. Hatch, 203 Monomoscoy Rd., Mashpee, MA (US) 02649; James R. Hickey, 21 Braeburn La., Ashland, MA (US) 01721

( * ) Notice: Subject to any disclaimer, the term of this patent is extended or adjusted under 35 U.S.C. 154(b) by 457 days.

(21) Appl. No.: 12/006,679

(22) Filed: Jan. 7, 2008

(65) Prior Publication Data

US 2010/0072230 A1 Mar. 25, 2010

(51) Int. Cl.
*B67D 7/06* (2010.01)

(52) U.S. Cl. ..... 222/534; 222/536; 222/538; 222/556; 222/566; 222/567

(58) Field of Classification Search ..... 222/530–534, 222/536–538, 555–556, 566, 548, 543, 482, 222/481.5, 484, 481, 567; 220/303, 361, 220/367, 373, 714, 717, 661
See application file for complete search history.

(56) References Cited

U.S. PATENT DOCUMENTS 470,838 A * 3/1892 Hart ..... 222/534
519,534 A * 5/1894 James ..... 222/534
521,113 A * 6/1894 Hart ..... 222/536
1,056,855 A * 3/1913 Tamagno ..... 222/534
1,075,611 A * 10/1913 Tamagno ..... 222/484
1,109,557 A * 9/1914 Tamagno ..... 222/498
1,417,951 A * 5/1922 Staples et al. ..... 222/534
1,537,399 A * 5/1925 Wiswell ..... 222/536
1,566,716 A * 12/1925 Wiswell ..... 222/536
1,570,114 A * 1/1926 Wiswell ..... 222/83
1,588,218 A * 6/1926 Wiswell ..... 222/536
3,265,256 A * 8/1966 Chaber et al. ..... 222/534
3,786,964 A * 1/1974 Landen ..... 222/153.14
5,671,868 A * 9/1997 Herr ..... 222/1
D608,855 S * 1/2010 Hatch et al. ..... D23/211.1

* cited by examiner

*Primary Examiner*—Frederick C. Nicolas
(74) *Attorney, Agent, or Firm*—William Nitkin

(57) ABSTRACT

A gasoline can having a nozzle assembly which includes a ball valve that is in an open mode when the can's nozzle is lifted for pouring, and which when the can's nozzle is in a lowered storage mode, the ball valve is closed.

7 Claims, 5 Drawing Sheets

GASOLINE CAN

BACKGROUND OF THE INVENTION

1. Field of the Invention

The device of this invention resides in the area of portable fluid transportation containers and more particularly relates to an improved portable container for carrying fuel, such as gasoline, which container provides a sealing means in the nozzle when the container is in a storage mode to prevent the escape of volatile organic compounds (VOCs).

2. Description of the Prior Art

Portable containers for the transport of liquid fuel are commonly referred to as gasoline cans. Currently gasoline cans are generally made of blow molded plastic and have nozzles which are separable therefrom and which nozzles can be positioned back within the gasoline can orifice for storage. Recent developments in gasoline can technology provide means to prevent escape of VOCs into the atmosphere. In practice many trades people who use portable gasoline cans often leave them after use with their nozzles attached and facing upwards without capping them to prevent the VOCs from being released into the atmosphere. The need to prevent of the escape of VOCs from gasoline cans is urgent, and many regulatory organizations such as the California Air Research Bureau have formulated specifications for gasoline cans to assure that they do not emit VOCs into the atmosphere. These regulations are being adopted by more and more states.

Current gasoline cans in use today are derived from the old, metal "Jerry cans" that were used in WWII. Today's gasoline cans are composed of high-density polyethylene rather than of metal. Thus they are very rugged and impervious to the constituent elements of gasoline, kerosene and diesel fuel. Gasoline cans are available in different sizes, such as 2.5 gallon and 5 gallon cans. In recent years they have been color-coded to reflect their contents where a red can indicates that it contains gasoline; a yellow can, diesel fuel; and a blue can, kerosene.

Portable gasoline cans are used by home owners, for example, to fill lawn mowers; and such use accounts for a significant amount of VOC emissions escaping into the air. According to calculations from the U.S. Environmental Protection Agency, emissions from gasoline cans contribute approximately 22.4 tons of volatile organic compounds (VOCs) per day just in the Chicago metropolitan area. VOC emissions from gasoline cans can also occur due to evaporation and from fuel spillage; therefore it is desirable to have a gasoline can that includes shutoff means for preventing fuel evaporation and inadvertent spillage.

SUMMARY OF THE INVENTION

It is an object of this invention to provide an improved gasoline can that has an automatic nozzle shutoff when pouring of gasoline ceases.

It is a further object of this invention to provide an easy and quick means for storing the nozzle of the gasoline can when the gasoline can is not being used.

It is a still further object of this invention to provide means for controlling the flow of gasoline so that it does not continue to pour when the nozzle is withdrawn from the object receiving the gasoline.

Although this application refers to the portable container of this invention as a gasoline can, it should be clearly understood that the container can hold any fuel, such as diesel fuel, kerosene or other volatile fluid, and its use is not strictly limited to gasoline. Applicant intends that the definition of "gas" or "gasoline" when used in reference to the container herein includes the use of such container with any volatile fuel or liquid.

The nozzle of this invention when in its downward closed mode allows for the storage of gasoline in the can and prevents the escape of VOCs. When one needs to pour gasoline from the can, the nozzle is raised to its upright open mode and inserted into the object receiving the gasoline and the gasoline can is lifted to allow the gasoline to be poured. When the pouring of the gasoline is completed, one lowers the gasoline can and pulls out the nozzle which action causes the nozzle to automatically shut off as soon as it is pulled out of the object in which the gasoline is being poured. This feature immediately eliminates any vapors (VOCs) from escaping into the atmosphere. This automatic shut-off feature is achieved by the nozzle having a spring-loaded retractable mechanism within the nozzle mount such that as the nozzle is removed from the object into which the can is pouring gas, it automatically retracts downward into its storage position until it is fully seated in a recess channel formed in the can itself. The automatic retraction of the nozzle, as discussed above, eliminates the need to retrieve the nozzle such as is needed in the use of prior art gasoline cans. In the instant invention when one desires to fill the gasoline can, one can easily remove the nozzle to expose the filling hole by rotating the nozzle one-quarter of a turn whereby the nozzle itself can act as a lever arm. The use of the positive locking system of the nozzle of this invention allows the nozzle to be rotated only one-quarter of a turn to open the gasoline can. This feature reduces the occurrence of cross-threading which often occurs to nozzles that are screwed on and off a gasoline can. Further the nozzle of this invention is tethered to the gasoline can so that it cannot be mislaid or lost when it is removed from the fuel entry aperture. The nozzle of this invention is in compliance with the current guidelines promulgated by UL/CSA California Air Research Bureau (CARB).

In use, the nozzle and the vent structure allow the rate of gasoline flow to be easily controlled by inserting the nozzle in the receptacle to receive the gasoline and gradually lifting the gasoline can and rotating it into its full-pour position. The stream of flow can be diminished by lowering the angle of the gasoline can to the receptacle, allowing the nozzle to start moving toward its storage position which action starts to shut off and decrease the flow of gasoline accordingly, thus preventing gas fumes of VOCs from escaping. This feature of the present invention is extremely important in meeting today's clean air standards.

The blow molded gasoline can of this invention can have a top hand opening on the top of the gasoline can and a rear hand opening at the rear of the gasoline can. The top hand opening can be easily grasped and held both when the gasoline can is upright and the nozzle is down in its storage mode with the opening closed to the fuel therein. The rear hand opening at the rear of the gasoline can can be used when pouring the gasoline from the gasoline can when the nozzle has been lifted into an open, use mode position. The nozzle as well as the gasoline can can be molded from a gas-resistant high-density polyethylene plastic which allows the nozzle to be used for pouring gasoline. The nozzle assembly can have gaskets to prevent gasoline from leaking from the can or from the nozzle assembly in its storage mode; and the nozzle, when fully raised into its use mode, provides for an unimpeded flow of fuel to its maximum flow rate which flow rate can be controlled by raising or lowering the position of the nozzle to the gasoline can which can be controlled once the nozzle is in position within the desired fuel receptacle by raising or lowering the angle of the gasoline can to the nozzle.

DESCRIPTION OF THE PREFERRED EMBODIMENT(S)

Figure 1:
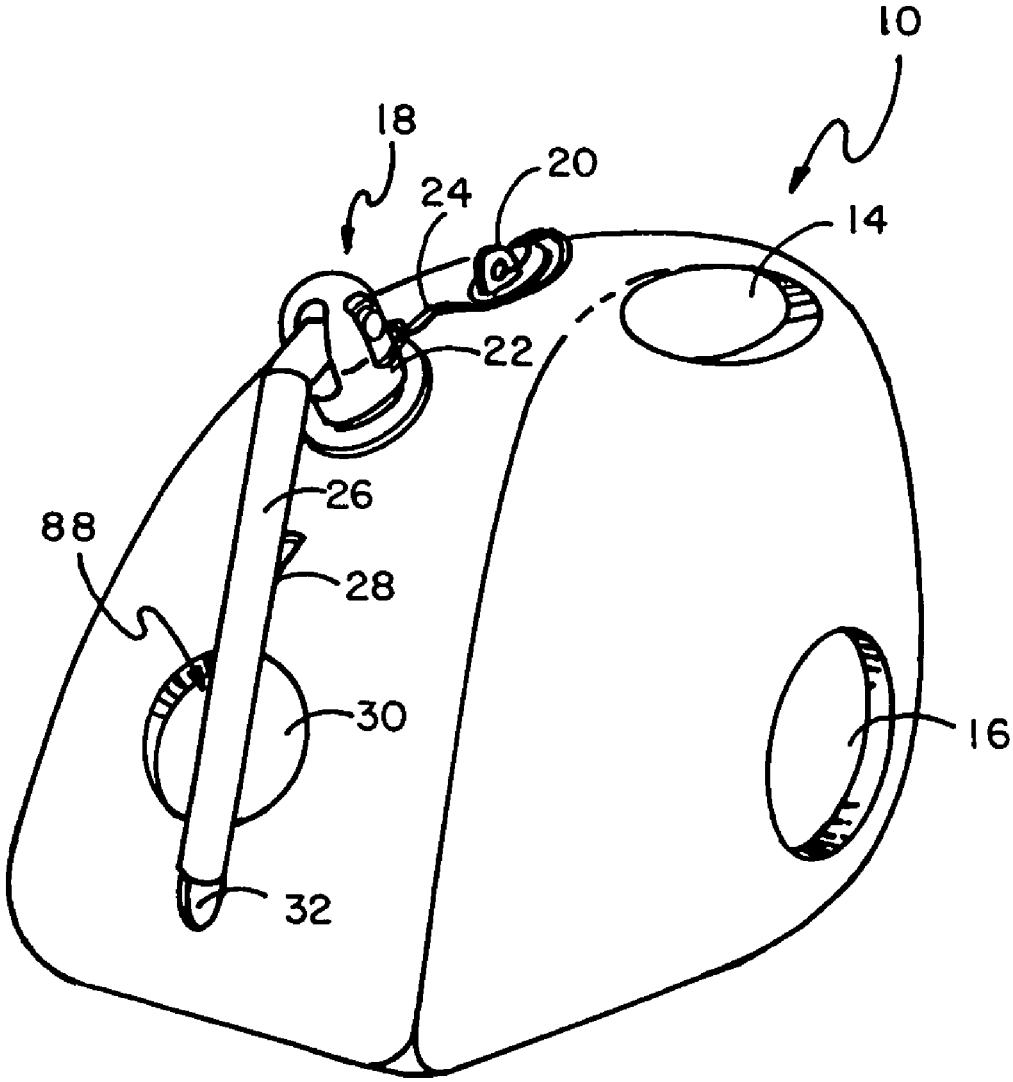
FIG. 1 illustrates a front perspective view of the gasoline can of this invention, showing the nozzle in its downward storage position.
Figure 2:
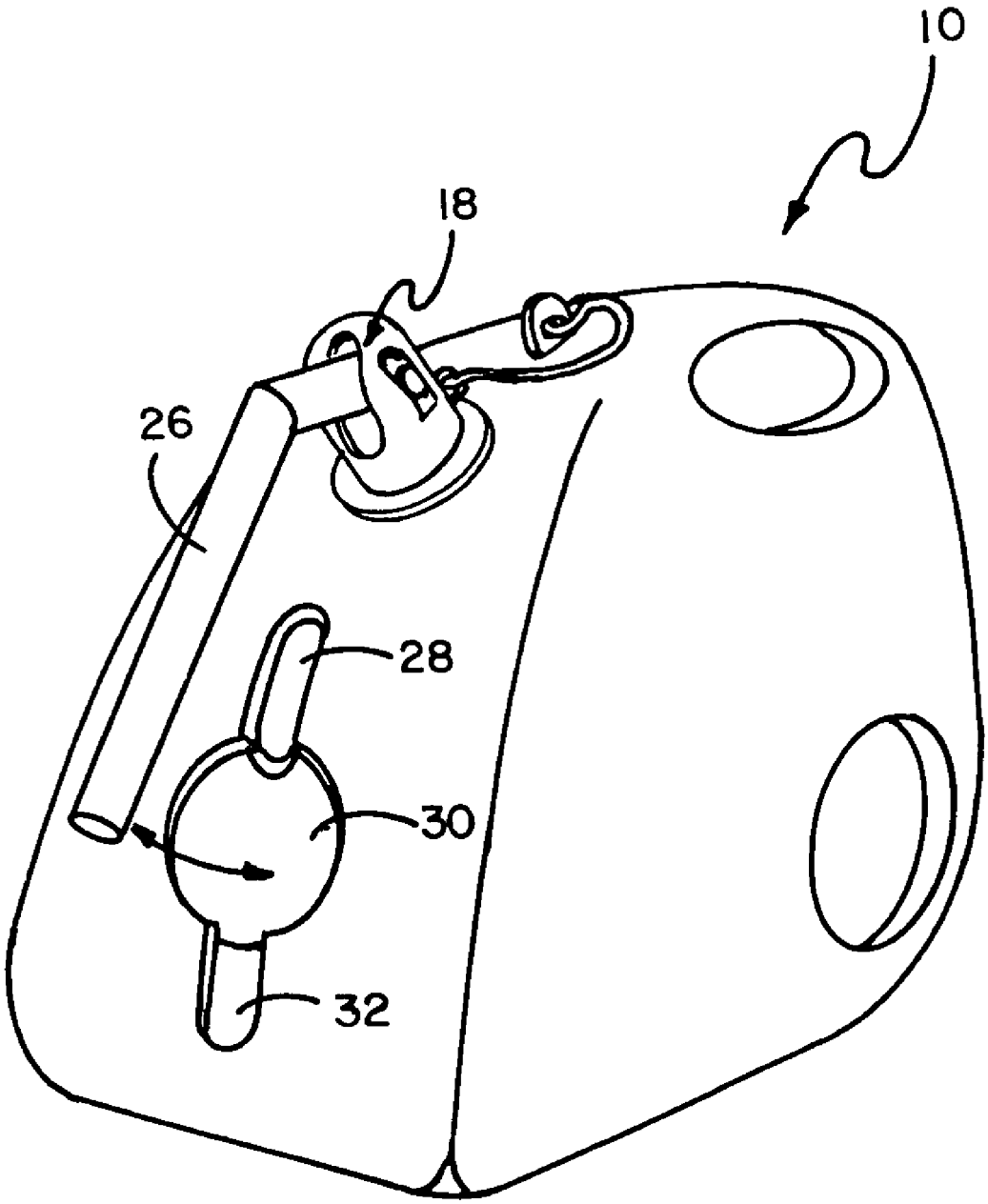
FIG. 2 illustrates a front perspective view of the gasoline can of FIG. 1, showing the nozzle starting to be lifted out of its storage position.
Figure 4:
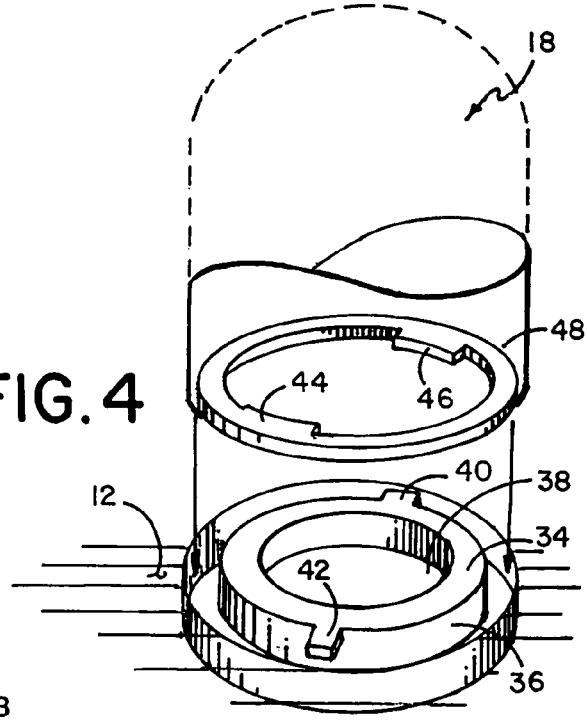
FIG. 4 illustrates a perspective view of the fuel entry aperture of the gasoline can showing its interlock mechanism for engaging the nozzle assembly.
Figure 3:
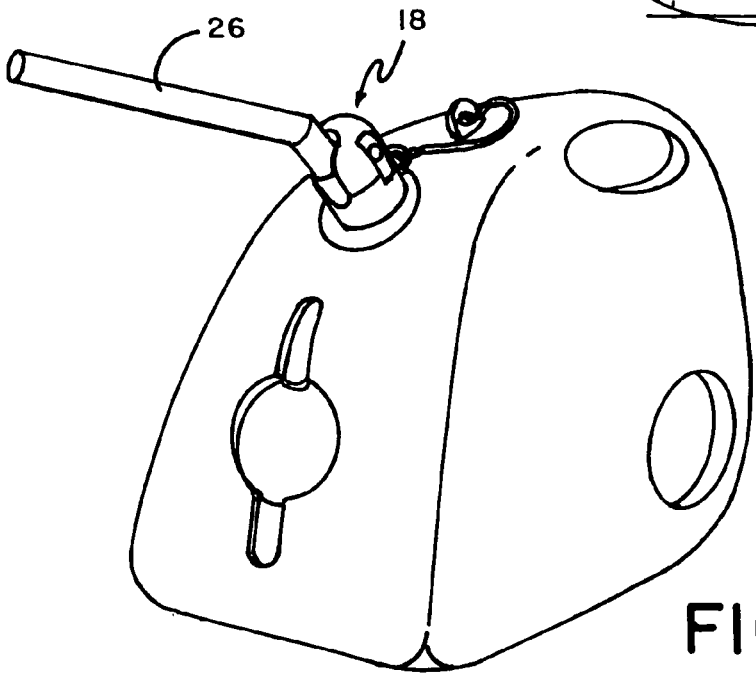
FIG. 3 illustrates a front perspective view of the gasoline can of FIG. 1, showing the nozzle lifted upwards into its use position to allow the flow of gasoline from the interior of the gasoline can through the nozzle.
Figure 5:
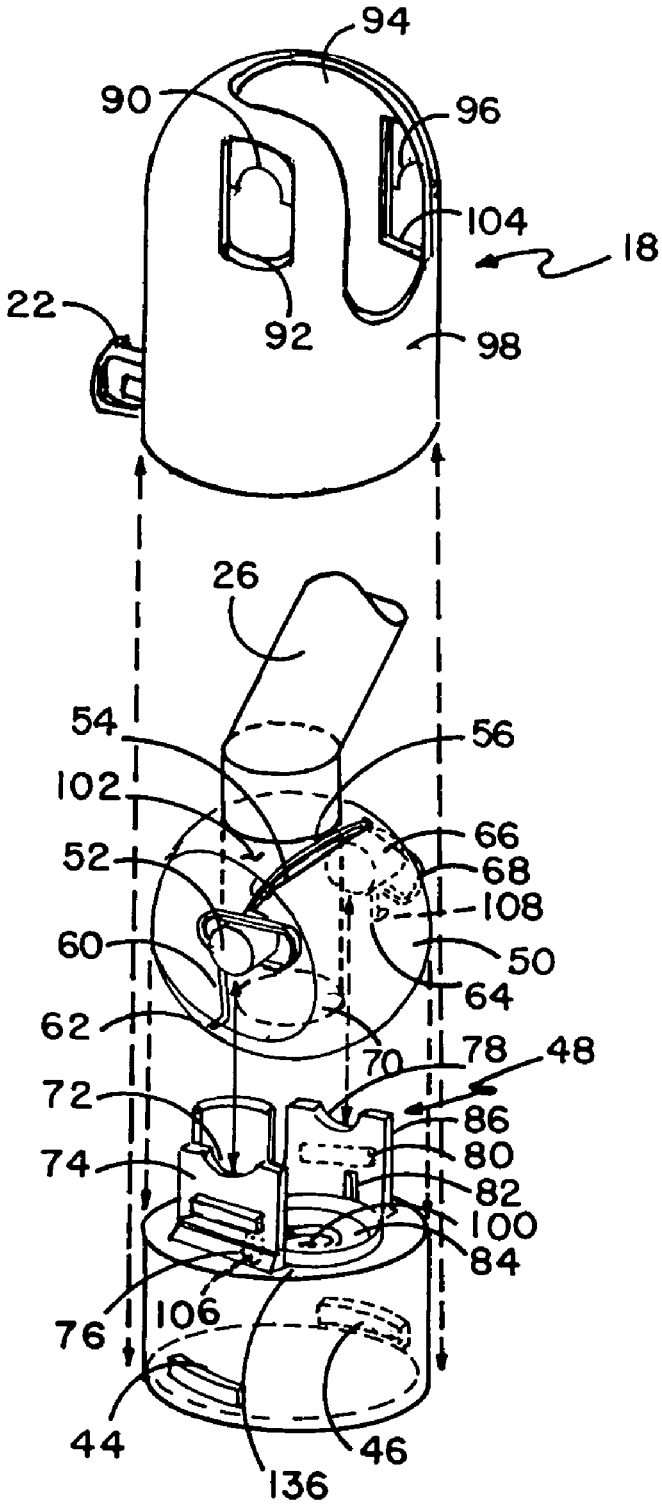
FIG. 5 illustrates an exploded perspective view of the nozzle assembly of this invention.
Figure 6:
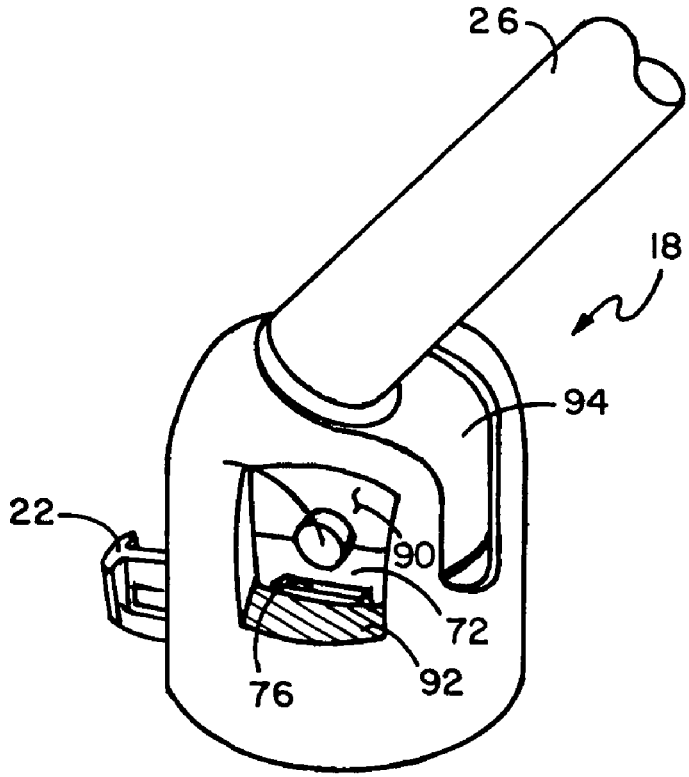
FIG. 6 illustrates a perspective view the nozzle assembly, showing the nozzle in its use position.

FIG. 1 illustrates a front perspective view of gasoline can 10 of this invention which can be made of blow-molded high-density polyethylene plastic. Gasoline can 10 has a top portion, a bottom portion, a front, a rear and sloped sides with the bottom portion being wider than the top portion. In one embodiment gasoline can 10 can have an opening at the top rear portion forming upper hand hold 14 and a second opening near the lower rear thereof forming lower hand hold 16 for the user to more easily hold the gasoline can when carrying it and when pouring fuel from it. In FIG. 1 nozzle 26 is shown in its nonuse mode where nozzle 26 is shown inserted into its nozzle receipt slot 88 made up of upper nozzle receipt area 28 which extends downward to mid-nozzle hand receipt area 30 which is wider and generally can be semicircular in configuration and extends further downward to lower nozzle receipt area 32. Nozzle receipt slot 88 can be molded as part of the formation of gasoline can 10 so that when nozzle 26 is moved down to its storage mode, it will fit within nozzle receipt slot 88. Having the mid-nozzle hand receipt area 30 wider than nozzle 26 allows the user to manipulate his fingers around nozzle 26 to lift nozzle 26 out of its storage mode, as seen in FIG. 2, where nozzle 26 has started to be lifted upwards toward its use position which, as seen in FIG. 3, where nozzle 26 has been pulled all the way upward into its use mode and is now open and ready to pour the fuel from within the gasoline can. Nozzle 26 is held in place by nozzle assembly 18 which is attached to fuel entrance aperture 38, as seen in FIG. 4, formed in the top of gasoline can 10. In FIG. 5 nozzle 26 is removably engaged to fuel entrance aperture 38, as described further below, by insertion therein and rotation for interlocking thereto so that nozzle 26 is held in position on gasoline can 10. A releasable locking device can be utilized to help securely retain nozzle assembly 18 in position until unlocked, if desired. Nozzle assembly 18, since it is separable from gasoline can 10, can be tethered to gasoline can 10 by having nozzle cable attachment member 22 formed thereon with a cable 24 attached to cable attachment member 22 and extending to can cable attachment member 20 which can be formed as part of gasoline can 10 such that even when nozzle assembly 18 is disengaged from gasoline can 10 for adding fluid to can 10 through fuel entrance aperture 38, nozzle assembly 18 will not be separated from gasoline can 10 and will be retained thereto by cable 24 to avoid becoming inadvertently lost.

Attachment of nozzle assembly 18 to gasoline can 10 can be accomplished by having fuel entrance aperture ring 34 disposed around fuel entrance aperture 38, such fuel entrance aperture formed at the top front portion of gasoline can 10, as best seen in FIG. 4, which has a receipt channel 36 defined within the plastic of gasoline can 10 around the fuel entrance aperture ring 34, which fuel entrance aperture ring 34 has extending therefrom two small catch portions that extend over receipt channel 36, being first catch member 42 and second catch member 40. First and second catch members 42 and 40 are positioned opposite one another and extend over receipt channel 36 so that there is space defined under each catch member. Nozzle assembly 18 is composed of three sections, the first being lower housing 48 which at its base has first projection 44 and second projection 46 positioned opposite one another and which extend inward from lower housing 48 which is circular. First and second projections 44 and 46 are sized to be positionable into receipt channel 36 such that when lower housing 48 is maneuvered into receipt channel 36 and rotated, first and second projections 44 and 46 are rotated, respectively, under first and second catch members 42 and 40 so as to engage nozzle assembly 18 in place on gasoline can 10.

Lower housing 48, as seen in FIG. 5, can have a platform 136 positioned above first and second catch members 42 and 40 with first support member 74 and a second support member 86 positioned opposite one another thereon. Ball seat 84, which can be resilient, is defined in platform 136 at the base of lower housing 48 above first projection 44 and second projection 46 and between first and second support members 74 and 86, such ball seat 84 having fuel aperture 100 defined in the center thereof which fuel aperture is aligned with fuel entrance aperture 38. The midsection of nozzle assembly 18 is ball valve 50 which is substantially spherical but which can have its sides flattened. Extending from the center of each flattened side are first ball valve trunnion 52 and second ball valve trunnion 66 which are disposed opposite to one another. First and second ball valve trunnions 52 and 66 are adapted to fit, respectively, within and rest on first seat 72 and second seat 78. First and second seats 72 and 78 are semicircular in configuration and are defined, respectively, in the top of first and second support members 74 and 86 such that when ball valve 50 is placed down onto first and second support members 74 and 86, their respective trunnion members each rotatably rest on their respective seats. The wider circumference of the central portion of the generally spherical ball valve 50 engages in fluid-tight fashion against resilient ball seat 84. Ball valve 50 has a ball valve channel 102 extending therethrough having ball valve entry aperture 70. When nozzle 26 is lifted to its upward use position, attached ball valve 50 is also moved to its upward use position, as seen in FIG. 5, where ball valve entry aperture 70 aligns with fuel aperture 100 in ball seat 84. Ball valve channel 102 extends through ball valve 50 and is in alignment with the interior of nozzle 26 where nozzle 26 is attached to ball valve 50 such that when the nozzle is in its upward use mode position, ball valve channel 102 is aligned with fuel entrance aperture 38 defined in gasoline can 10. Alternatively, when nozzle 26 is rotated to its lower nonuse position, ball valve entry aperture 70 is no longer aligned with fuel aperture 100 in ball seat 84 and prevents fluid VOCs from passing out gasoline can 10 into nozzle 26, thus securely sealing the gasoline can. The upper section of nozzle assembly 18 is nozzle housing 98 which is dome-shaped and has a slot 94 defined therein in which nozzle 26 moves. Housing 98 is inserted, as seen in the exploded view of FIG. 5, over nozzle 26 and attached ball valve 50 which is seated with its first and second ball valve trunnions 52 and 66 resting on their respective first and second seats 72 and 78 such that nozzle housing 98 can lock, hold and engage first ball valve trunnion 52 and second ball valve trunnion 66 by the engagement thereonto of first trunnion cap 90 and second trunnion cap 96 which are formed as part of nozzle housing 98. The bases of first and second trunnion caps 90 and 96 are semicircular in shape and form a complete circle, respectively, with first and second seats 72 and 78 around the circular first and second ball valve trunnions 52 and 66 to securely hold ball valve 50 in position in nozzle assembly 18. Nozzle housing 98 has a first protrusion catch member 92 which extends inward a short distance and is positioned opposite second protrusion catch member 104 which also extends inward a short distance. When nozzle housing 98 engages down onto and over the ball valve 50, first protrusion catch member 92 moves downward and engages under the first protrusion 76 extending out from the side of first support member 74; and second protrusion catch member 104 moves downward and engages under second protrusion 80 in second support member 86 so as to lock and retain nozzle housing 98 in place on lower housing 48.

Figure 7:
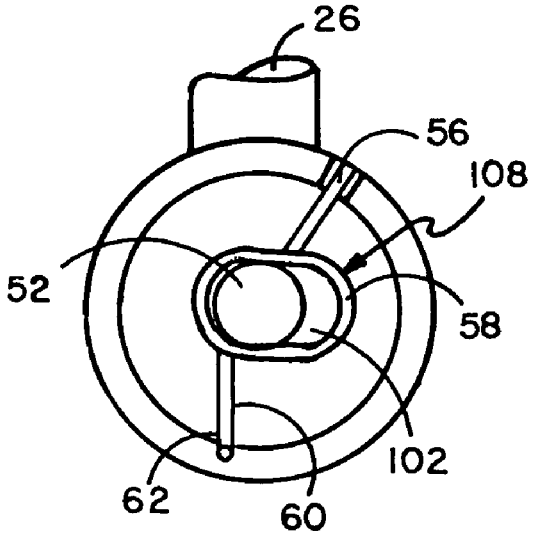
FIG. 7 illustrates a side elevational view of the ball valve of this invention, showing the closure spring member in a first open mode.
Figure 8:
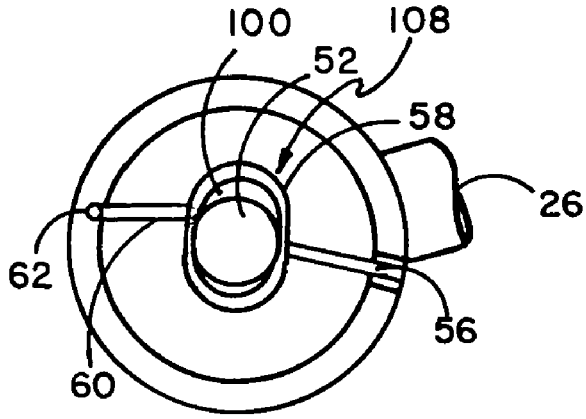
FIG. 8 illustrates a side elevational view of the ball valve of this invention, showing the closure spring member in a closed mode exerting pressure to cause the nozzle to be in its downward storage position.

The rotating movement of ball valve 50 is also aided by the presence of spring member 108 which provides resistance to prevent inadvertent upward movement of nozzle 26 from its downward nonuse position. Spring member 108, as seen in FIG. 5, consists of a single spring member which forms first spring member loop 58 and second spring member loop 68, respectively, on each side of ball valve 50. First and second spring member loops 58 and 68 are generally formed in a double loop in an elongated oval shape, respectively, around first ball valve trunnion 52 and second ball valve trunion 66, as seen in FIGS. 5, 7 and 8. Spring member 56 then extends downward to form first and second spring member extensions 60 and 108. Spring member 56 then extends downward and then outward, respectively, from first and second spring member loops 58 and 68 to form, respectively, first catch member 62 and second catch member 64 which engage, respectively, into first and second spring catch apertures 106 and 82 formed in lower housing 48 for retention. Spring member 56 rests in spring member channel 54 defined near nozzle 26 in ball valve 50 such that spring member 56 is prevented from moving separately and moves with ball valve 50. When the nozzle is rotated upwards from its storage position, tension is created in spring member 56. When nozzle 26 is in its storage position, each trunnion shaft rests in the bottom position of its respective elongated spring member loop, as best seen in FIG. 8, holding nozzle 26 in place in nozzle receipt slot 88. As one rotates nozzle 26 upwards and it reaches its upward use position and putting tension of first and second spring member extensions 60 and 108, first and second ball valve trunnions 52 and 66 are more engaged, respectively, into the opposite ends of elongated first and second spring member loops 58 and 68 which urge against upward movement, as seen in FIG. 7. Thus if left in a nonuse mode, first and second spring member extensions 60 and 108 would urge the nozzle to move downward into its storage position.

Although the present invention has been described with reference to particular embodiments, it will be apparent to those skilled in the art that variations and modifications can be substituted therefor without departing from the principles and spirit of the invention.

We claim:

1. A gasoline can for the storage of fuel, comprising:

a container having a top, bottom, front, rear and first and second sides, said front having an upper portion and said rear having an upper portion;

a fuel entry aperture defined in said upper portion of said front of said container;

a nozzle assembly having:

means for engagement to said fuel entry aperture, said nozzle assembly having a storage mode and a use mode;

a ball valve disposed above said nozzle assembly's means for engagement to said fuel entry aperture, said ball valve having a spherical portion and flattened first and second sides, said ball valve having a channel defined therethrough around which channel is defined a point of attachment;

a nozzle having a length, a first end, a second end and an opening defined therethrough along said length, said nozzle being attached to said ball valve at said point of attachment, said opening aligned with said channel in said ball valve, said nozzle being able to be raised and lowered;

first and second trunnions extending, respectively, from said first and second sides of said ball valve, a nozzle assembly lower portion formed as part of said means to engage said nozzle assembly to said container, said nozzle assembly lower portion having first and second trunnion seats for receiving, respectively, said first and second trunnions; and a nozzle assembly upper portion having first and second trunnion caps for engagement, respectively, over said first and second trunnions for holding said first and second trunnions such that said first and second trunnions are rotatable when said first and second ball valve trunnions are engaged, respectively, between said first and second trunnion seats and said first and second trunnion caps, said nozzle when lowered being in its storage mode, positioning said ball valve to block said fuel entry aperture in said container for sealing said container; and when said nozzle and attached ball valve are moved upwards to a use mode, said nozzle is raised to a point where its opening and aligned channel in said ball valve both align with said fuel entry aperture in said container for the outward pouring of fuel.

2. The gasoline can of claim 1 further including:

a ball valve seat disposed around said fuel entry aperture within said nozzle assembly lower portion.

3. The gasoline can of claim 2 wherein:

said ball valve seat is positioned above said engagement means;

said first and second trunnion seats are positioned above said ball valve seat;

said spherical portion of said ball valve is urged against said ball valve seat for forming a fluid-tight engagement therewith;

said nozzle assembly upper portion is formed in a dome shape having an elongated slot defined therein, said dome-shaped nozzle assembly upper portion having said first and second trunnion cap members disposed therein for positioning, respectively, on top of said first and second trunnions for engaging said first and second trunnions securely in place yet allowing said ball valve and said first and second trunnions to rotate;

said nozzle when engaged to said ball valve being positioned for movement within said elongated slot in said nozzle assembly upper portion from said storage mode position to said use mode position; and said dome-shaped nozzle assembly upper portion of said nozzle assembly being lockable to said nozzle assembly lower portion for securely engaging said ball valve therein.

4. The gasoline can of claim 3 further including:

a spring member adapted for urging said nozzle down to its storage position within said nozzle assembly.

5. The gasoline can of claim 4 further including:

a nozzle receipt slot defined in said front of said container for receiving said nozzle when said nozzle is in its storage mode position.

6. The gasoline can of claim 5 wherein said nozzle receipt slot further includes a wider portion for allowing access for easy grasping of said nozzle.

7. The gasoline can of claim 6 wherein said spring member is comprised of a metal element that engages around said first trunnion, said spring member having a portion extending for engagement into an aperture defined in said nozzle assembly lower portion, said spring member extending around said spherical portion of said ball valve below said point of attachment of said nozzle to said ball valve within said channel defined in said ball valve, said spring member then extending around said second trunnion and further extending to a second point of engagement in an aperture defined in said nozzle assembly lower portion.

* * * * *